United States Patent [19]

Whitehouse

[11] Patent Number: 5,076,124

[45] Date of Patent: Dec. 31, 1991

[54] SIZING AND CUTTING APPARATUS

[75] Inventor: John A. Whitehouse, Norwich, United Kingdom

[73] Assignee: AEW Engineering Co Limited, Norwich, United Kingdom

[21] Appl. No.: 474,072

[22] PCT Filed: Oct. 7, 1988

[86] PCT No.: PCT/GB88/00844

§ 371 Date: Mar. 21, 1990

§ 102(e) Date: Mar. 21, 1990

[87] PCT Pub. No.: WO89/03180

PCT Pub. Date: Apr. 20, 1989

[30] Foreign Application Priority Data

Oct. 8, 1987 [GB] United Kingdom ..... 8723647

[51] Int. Cl.[5] ..... B26D 7/06; B26D 5/00

[52] U.S. Cl. ..... 83/105; 83/155; 83/365; 83/367; 83/813

[58] Field of Search ..... 83/365, 367, 155, 105, 83/813

[56] References Cited

U.S. PATENT DOCUMENTS

| | | | |
|---|---|---|---|
| 3,967,518 | 7/1976 | Edwards | 83/365 X |
| 4,420,997 | 12/1983 | Whitehouse | 83/155 X |
| 4,926,917 | 5/1990 | Kirbach | 83/367 X |

*Primary Examiner*—Timothy V. Eley

*Attorney, Agent, or Firm*—Lee, Mann, Smith, McWilliams & Sweeney

[57] ABSTRACT

Apparatus for sizing and bandsaw cutting of meat, wherein the pieces of product to be cut are mounted in a magazine for rotation around a path which intercepts a sensor means and a bandsaw, with the pieces resting on a vertically adjustable horizontal table, the sensor means being disposed in the surface of the table to sense the area of the lower face of the product, thereby to enable automatic adjustment of the level of the table so that the bandsaw cuts a slice of product of required size from the lower end of the pieces.

9 Claims, 8 Drawing Sheets

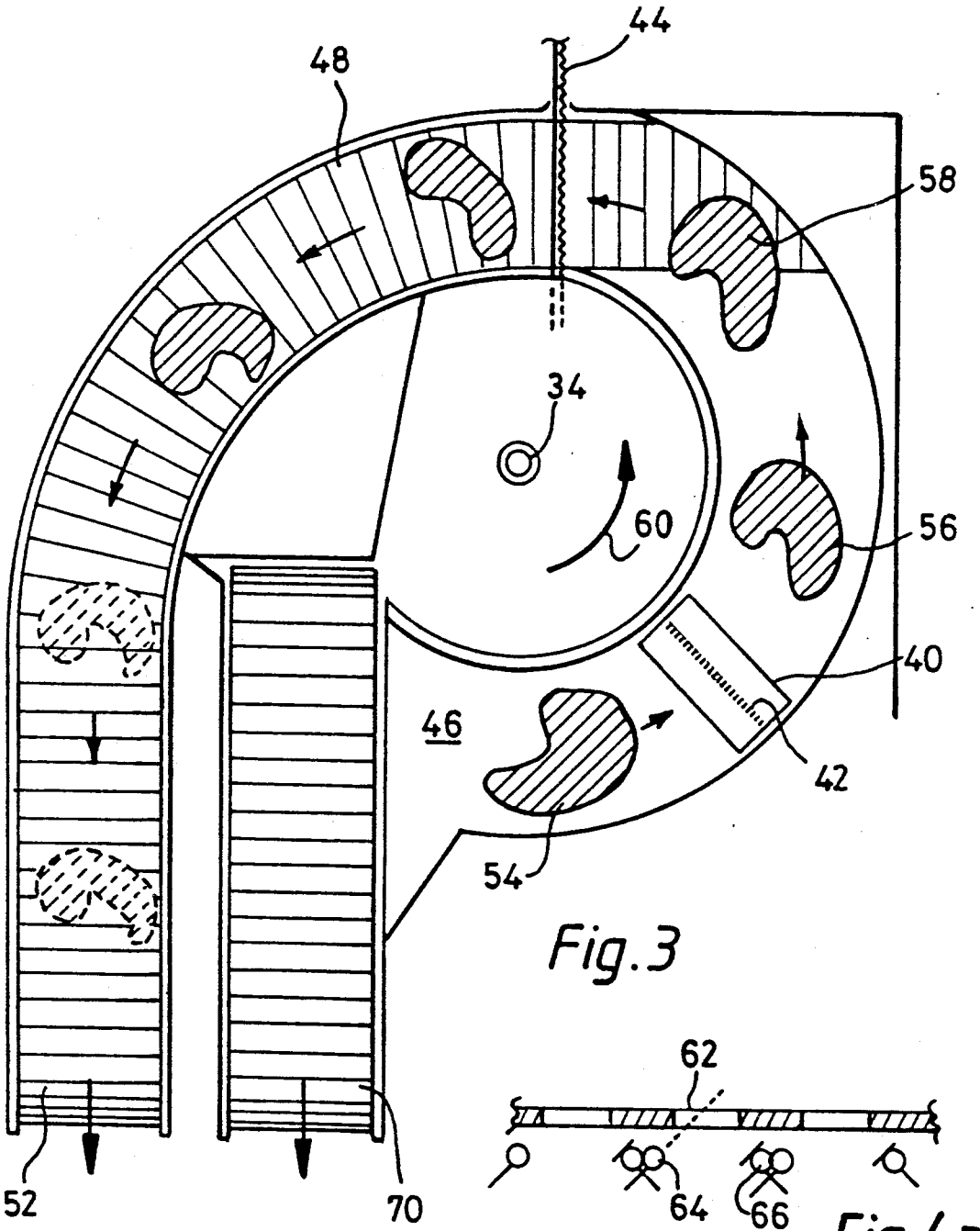
Fig. 3
Fig. 4a
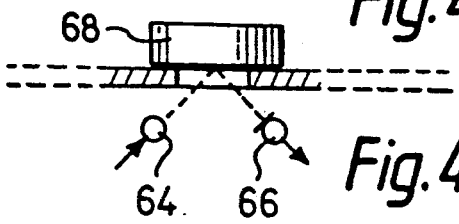
Fig. 4b

SIZING AND CUTTING APPARATUS

FIELD OF THE INVENTION

This invention concerns sizing and cutting apparatus for handling irregularly shaped products such as meat whereby the product is to be cut into uniform pieces. The invention is not however limited to use with meat.

BACKGROUND TO THE INVENTION

As discussed in UK Patent No. 2149650, with certain products, particularly meat, it is difficult to keep the size of cut portions constant. This is particularly the case when dealing with a product such as pork chops.

The earlier patent describes apparatus for cutting or sawing a product such as a side of pork into uniformly sized portions which includes means for determining the area of the end face of a region of the product from which pieces are to be cut or sawn, computing means having stored therein a numerical density value for the material to be cut and a numerical weight value corresponding to the desired weight per cut piece, the computing means being adapted to compute from the measured area of the end face, the depth of the cut required to obtain a piece of the desired weight. Means is provided for adjusting the depth of cut using the computed thickness value to obtain pieces of the desired weight and there is further means enabling correction of the numerical density value in the computing means by sampling the weight of a cut piece.

The apparatus described in the aforementioned patent specification includes a closed track around which a meat carrying platform moves with a piece of meat on the platform. A bandsaw cutter is located at one position around the track operating vertically and a guide deflects the cut slice onto a check weighing apparatus from where the checked pieces can be loaded into a bin or onto a conveyor. The movement of the platform around the track is controlled by a drive unit which itself is controlled from a control centre and the position of the bandsaw relative to the end face of the meat is also controlled by another drive unit which is computer controlled.

At a position remote from the bandsaw is located and X Y scanning device for producing an area signal corresponding to the area of the piece of meat which is next to be cut by the bandsaw.

Whilst such apparatus can be made to function at moderate speeds, high speed operation is limited due to the considerable spacing between the scanner and the bandsaw. Although it is possible to utilise the delay between the scanner and the bandsaw for the purpose of computing the depth to which the piece is to be cut, with even low speed computing techniques, the time period is excessive and the throughput of the machine is therefore considerably limited.

It is one object of the invention to provide a machine which whilst cutting to the same degree of accuracy will nevertheless allow a greater throughput of cut product.

It is a further object of the invention to apply the sizing technique described in the aforementioned patent No. 2149650 to a bandsaw in which the cutting is effected in a horizontal plane rather than a vertical plane.

It is a further object of the invention to provide a machine for cutting constant volume pieces of a product.

It is a further object of the invention to provide a sizing and cutting apparatus for removing constant volume pieces of product by a horizontally acting bandsaw in which the thickness of the material to be removed by the bandsaw is adjustable at high speed in response to an electrical signal relating to the area of the product concerned so as to enable variations in thickness of cut to be made "on the fly", to follow changes in cross-sectional size and shape of the product as pieces are removed therefrom, to enable pieces of constant volume to be delivered at the output of the machine.

SUMMARY OF THE INVENTION

According to one aspect of the present invention, in apparatus for sizing and cutting a product into uniformly sized portions, the product to be cut is mounted in a magazine by which it can be rotated around a circular path which intercepts at one point the horizontal section of a bandsaw and at another point a sensor from which an electrical signal can be computed which describes the area of the lower end face of the product, wherein the sensor lies in the horizontal surface on which the cut face of the product slides as the product is rotated around the circular path by the magazine.

Conveniently the sensor comprises a linear array of transmitters and detectors which may be addressed in sequence or whose outputs may be summed and the resulting analogue signal sampled as the product passes over the line of detectors, to effect a linear scanning of the array and wherein the presence of product immediately above the array causes transmitted energy to be reflected towards the detectors. The output state of the latter thus varies depending on whether product is immediately above the array or not and an area signal can be computed by integrating the electrical signals received from scanning the array of detectors as the product passes thereover.

The magazine may carry one or more large pieces of product from which the smaller pieces are to be cut and typically these are circularly arranged around the magazine so as to be presented one after another in turn first to the scanning sensor and then to the cutting blade of the bandsaw.

Typically the apparatus includes conveyor means for removing cut pieces from the path of the magazine to enable the material to drop down to present a fresh piece of product for cutting by the bandsaw on the next pass.

According to another aspect of the invention, the surface on which the lower end faces of the large pieces of product travel as the magazine rotates is integral with a table assembly which is movable relative to the magazine and at least the horizontal section of the bandsaw so as to adjust the depth of the product below the blade and therefore the thickness of the slice of material which will be removed by the cutting action of the blade.

Preferably drive means is provided for adjusting the height of the table assembly relative to the blade so as to allow for automatic control of the thickness of the cut slices and feedback means is provided from a computer to which area signals are supplied for controlling the depth of cut and therefore the thickness of the slices removed by the bandsaw. By ensuring that the computation is performed quickly and providing for high speed movement of the table assembly in a vertical manner either up or down, and by synchronising the adjustment of the table assembly with the movement of the magazine, so the height of the table assembly can be corrected between the time taken to scan the end face of the product and the arrival of the product at the blade so that precisely the correct thickness of product is removed by the cutting blade so as to maintain the volume of each piece of cut product substantially constant.

Typically the table assembly is raised or lowered by means of a rotatable lead screw typically driven by an electric motor, preferably a servo motor.

For particularly high speed operations, the mass of the table assembly may be matched by two or more pneumatic jacks acting against the underside of the table assembly and operated from a source of pressurised air or gas so as to provide an upward force on the table assembly which is never more than the downward force due to gravity of the table assembly. In this way the effective mass of the assembly is reduced to a very small amount and the energy required to accelerate the table assembly is significantly reduced thereby enabling the table assembly to be accelerated and decelerated at a higher rate with a giver motor than would otherwise be the case.

The pneumatic jacks are preferably provided with air or gas under a constant pressure and typically venting means is provided to enable the jacks to collapse rapidly so as to follow any downward movement of the table without exerting undue upward force on the table during its downward movement.

The venting means is preferably pressure responsive.

According to a further aspect of the invention, display means is provided for indicating a computed value for the weight of each cut slice determined by the depth of cut and area of the end face of the piece concerned. Conveniently the display means is a cathode ray tube.

If a check weighing device is provided at the outlet of the machine, a signal from the check weigher may be also displayed to indicate in the same display the actual weight measured for comparison purposes.

During high speed operation, the numerical values displayed may correspond to an average of the computed weight of cut pieces and an average of the actual weight of cut pieces passing over the check weigher.

The check weigher may be incorporated into the apparatus and form part of the apparatus or may be separate therefrom.

Since it is important to know precisely where each piece of product is during the circular path defined by the rotation of the magazine, the drive for the magazine preferably includes an encoder for circularly defining the position of the magazine relative to the cutting blade and the line of sensors for measuring the area.

Electrical signals for display on the display means may be derived from computing means which itself is supplied with signals from the scanner and the computing means may be located within the machine or may be remotely located and connected thereto by cables.

The servo motor is conveniently mounted remote from the lead screw jack and the latter is preferably driven by means of a toothed belt drive from the servo motor.

Preferably a powerful electromagnetic brake such as a disc brake is attached to the lead screw to arrest the motion of the latter when the desired height of the table assembly has been achieved.

Preferably vertical guides are provided within the machine and roller means is provided on the table assembly to cause the latter to move in a true vertical manner relative to the overall assembly of the machine with the rollers running vertically up and down the guides.

In a preferred embodiment of the invention, the radial array of inspection windows comprising the scanner is arranged at approximately 120° in advance of the cutting blade of the horizontal section of the bandsaw, when viewed in the direction of travel around the circular path determined by the rotation of the magazine.

The invention will now be described, by way of example, with reference to the accompanying drawings, in which:

FIG. 3 is a view of the meat cutting station from above with the rotary magazine and door removed to show diagrammatically the passage of pieces of meat around the meat cutting station over the sizing scanning window and past the cutting blade of a bandsaw to exit on the delivery conveyor;

Figure 1:
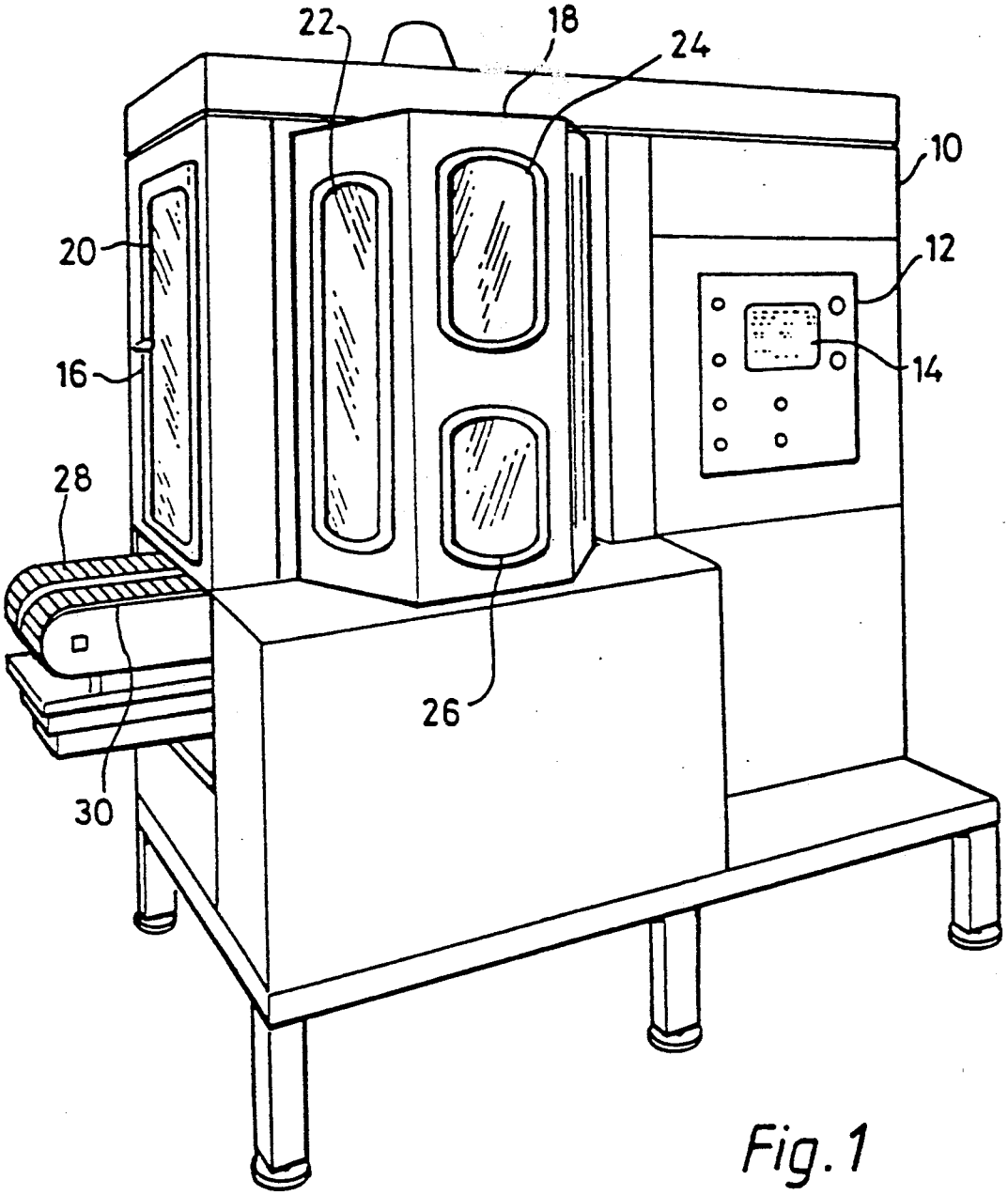
FIG. 1 is a perspective view of a meat cutting apparatus embodying the invention.
Figure 5:
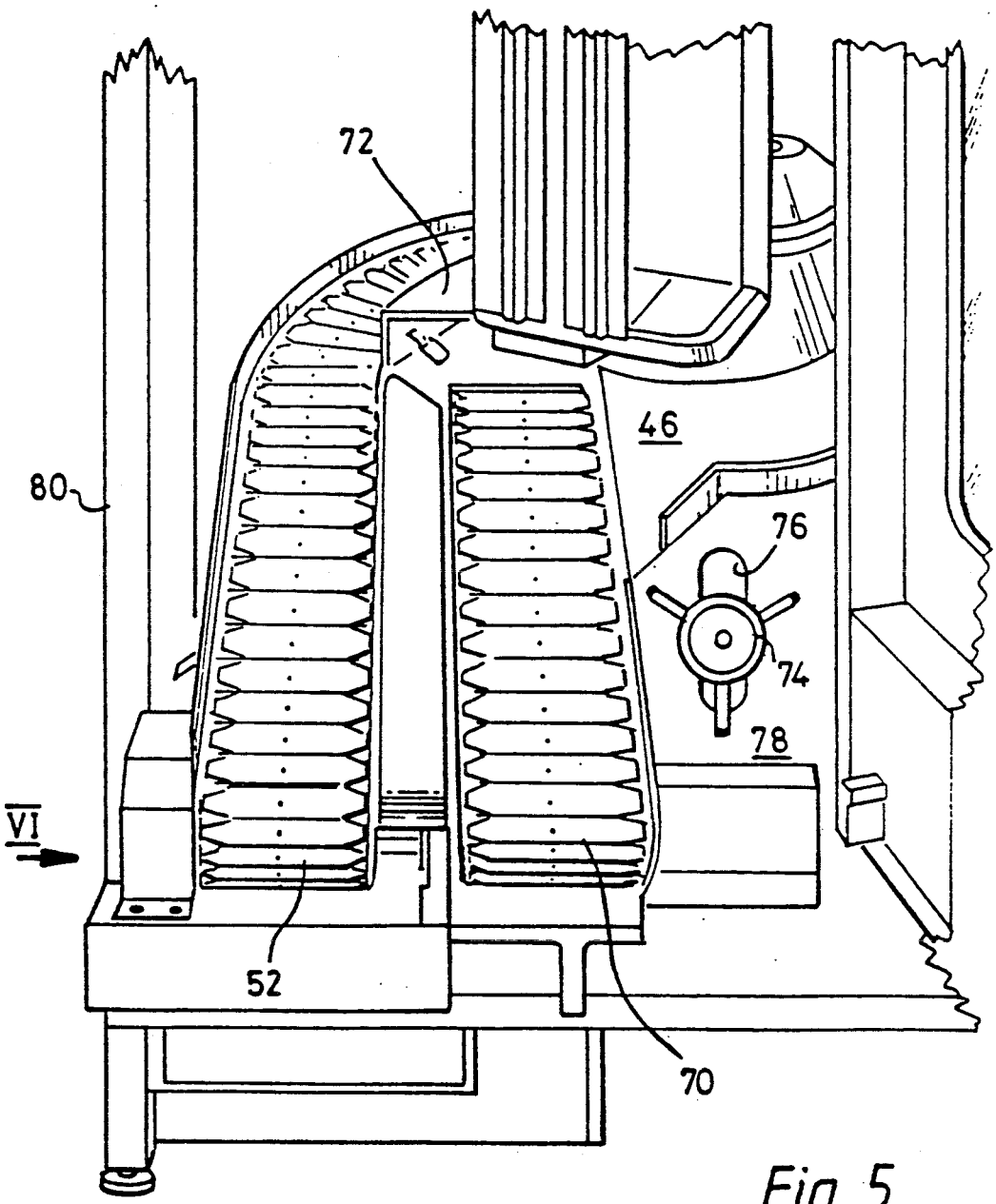
Figure 6:
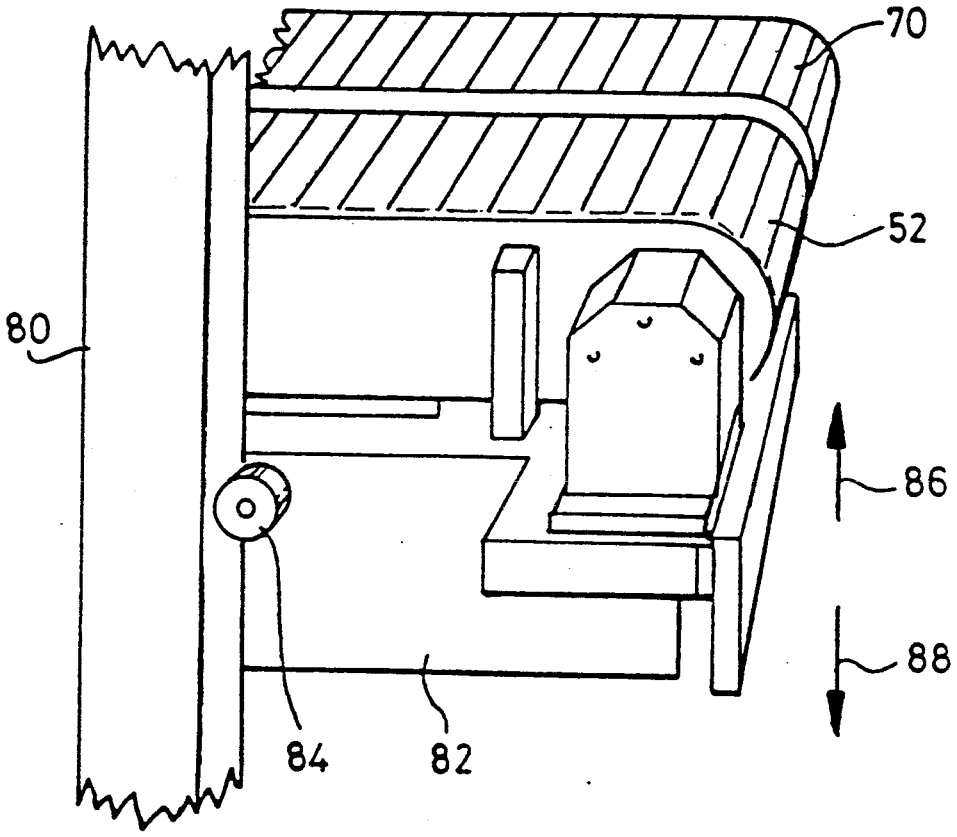
Figure 7:
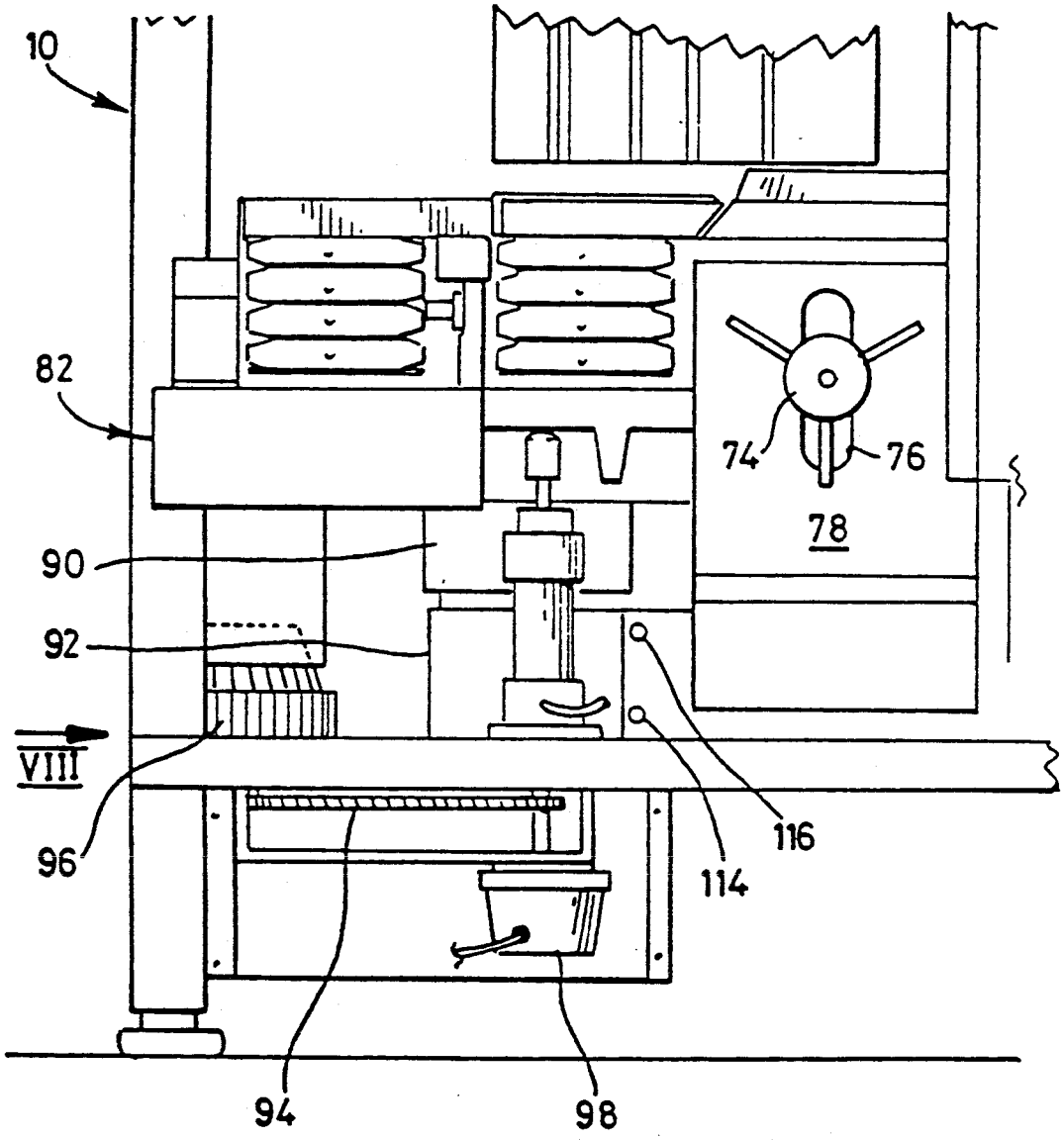
Figure 8:
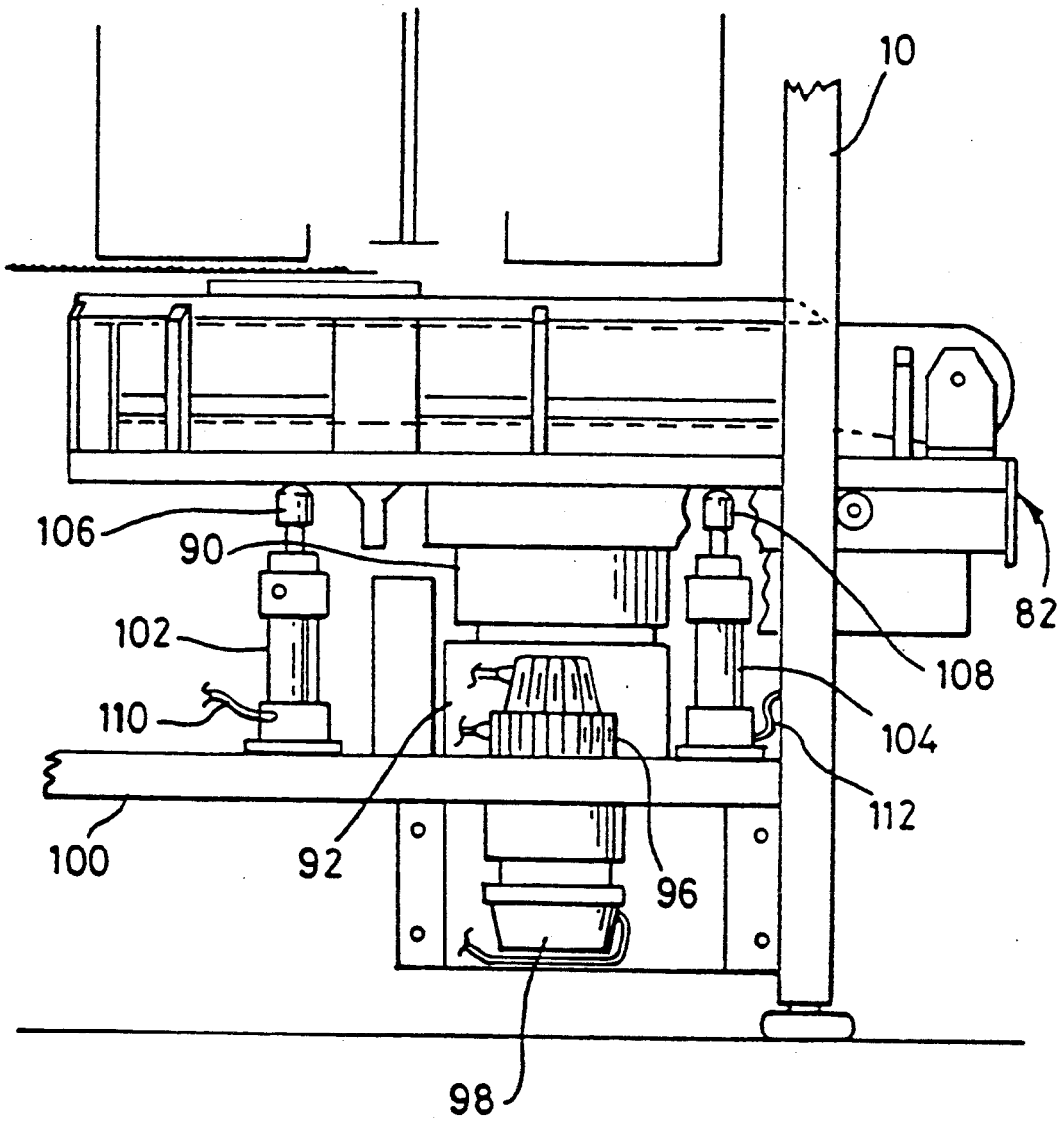
Figure 9:
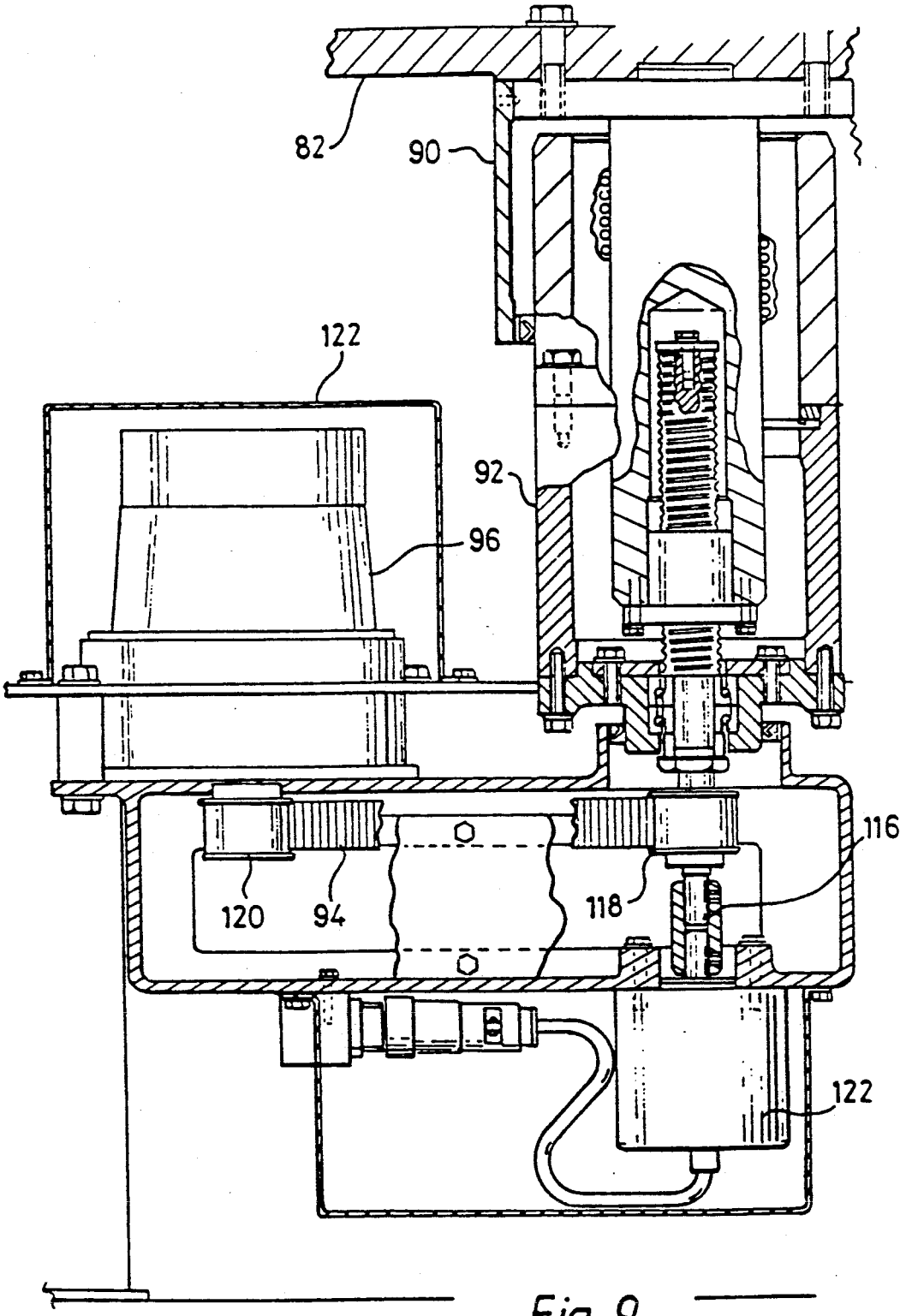

FIGS. 4*a* and 4*b* show the component parts of one of the elements of the linear scanning window and illustrate how the presence of meat produces a reflection to a receiver unit;

FIG. 5 is a perspective view to an enlarged scale of the delivery conveyors of the machine shown in FIG. 1;

FIG. 6 is a perspective view in the general direction of arrow VI of FIG. 5 and shows the guide and roller mechanism by which the movable table is constrained to move upwardly and downwardly in a vertical manner;

FIG. 7 is an elevation of the exit end of the machine shown in FIG. 5 with side panels removed to show part of the internal workings of the machine;

FIG. 8 is a similar elevation this time viewed in the direction of arrow VIII of FIG. 7, again with side panels of the machine removed showing the two pneumatic cushions and lead screw drive for the movable table, and FIG. 9 is a part sectioned view, to an enlarged scale, through the lead screw table elevating mechanism and drive means therefor.

DETAILED DESCRIPTION OF THE DRAWINGS

As shown in FIG. 1, meat cutting and sizing apparatus is housed within a housing 10 which includes a control panel 12 containing a television screen 14 for displaying information relating to the process, a meat cutting station access to which can be gained through a first door 16 and a second door 18, both of which are shown in their closed position and which include viewing windows 20, 22, 24 and 26. Meat pieces cut from large pieces of meat located within the cutting station exit on a product delivery conveyor 28 and pieces which are of insufficient thickness, such as ends, are removed by conveyor 30.

Figure 2:
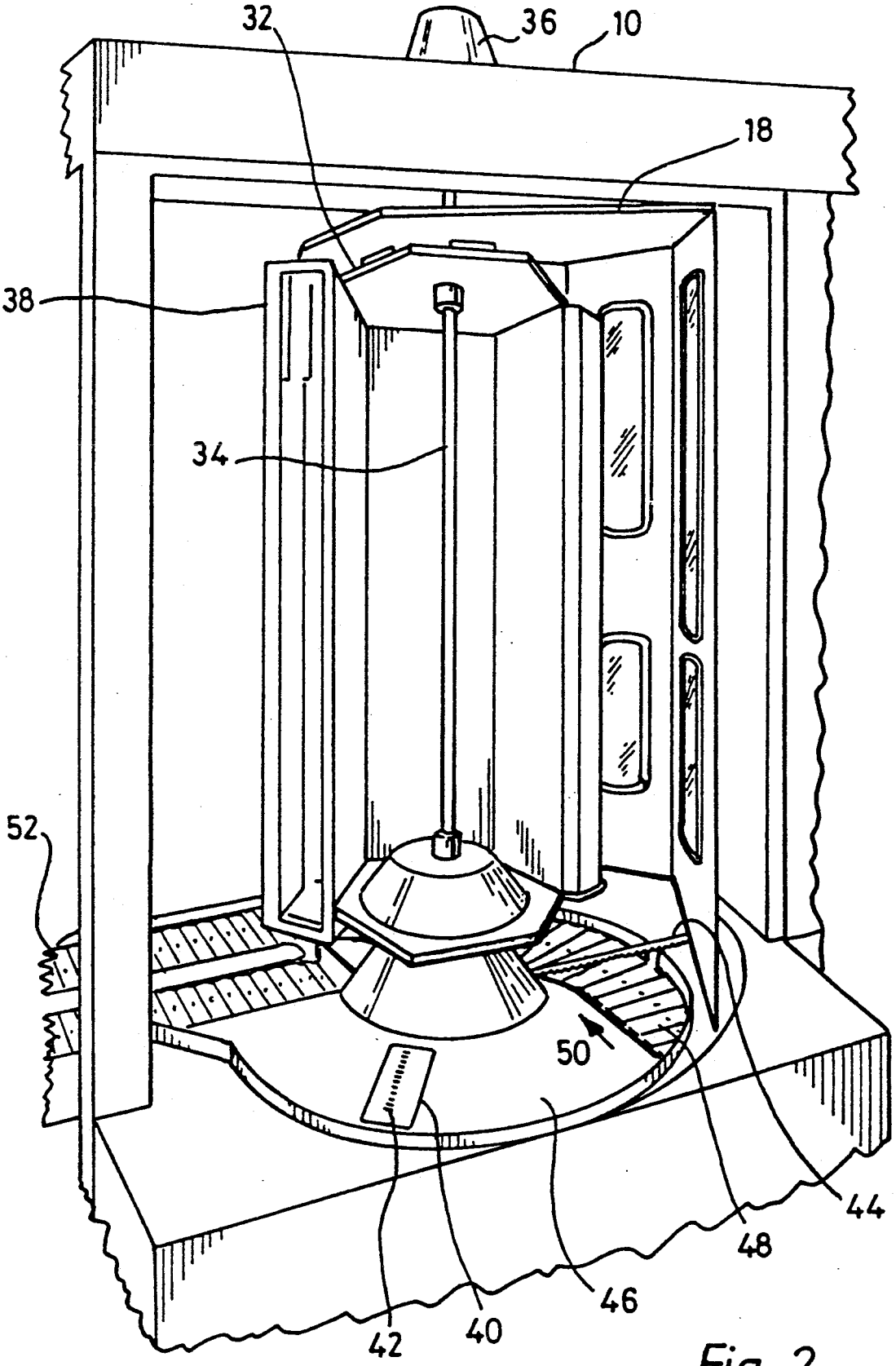
FIG. 2 is a perspective view to an enlarged scale of the meat cutting station of the apparatus shown in FIG. 1 with the main machine door rotated inboard to permit loading and unloading.

FIG. 2 shows the interior of the meat cutting station and is accessible by rotating the door 18 to the internal or inboard position shown in FIG. 2. Suspended within the cabinet 10 is a rotatable magazine generally designated 32 having a vertical shaft 34 on which it is carried and which is rotated by a drive motor (not shown) which may be at the top of the housing or located below the cutting station as desired. An encoder unit is shown at 36. The encoder 36 provides electrical signals indicating the rotational position of the magazine. Side panels such as 38 are removable from the magazine by unhitching from top and bottom plates attached to the shaft 34, to enable meat carcass or other like material to be mounted thereon and positioned within the magazine.

On rotation, the lower end of a piece of meat carried by the magazine passes over a plate 40 containing a line of apertures 42 forming a scanning or viewing window (to be described later) and thereafter is moved towards the horizontal section 44 of a bandsaw so that the lowermost part of the meat which is resting on the flat table 46 is removed from the remainder of the material by the saw blade, and is immediately drawn away from the remainder of the meat by the movement of a conveyor the slats of which are shown at 48 and which moves in the direction of the arrow 50. The conveyor describes a generally circular path and then exits from the meat cutting station in a straight line at 52 and delivers cut pieces of meat to a collecting bin or the like.

The principle of operation is perhaps best seen with reference to FIG. 3 in which the magazine and the door shown in FIG. 2 have been removed and in which the meat cutting station is viewed axially from above. A number of pieces of meat are shown circularly arranged around the shaft 34 as at 54, 56, 58 etc and the direction of rotation is shown by the arrow 60. The piece of meat 58 is shown approaching the horizontal section 44 of the bandsaw and as the magazine rotates the meat through the saw, the lowermost region of the meat is removed from the remainder and drawn away on the conveyor 48 to leave the machine along the exit path 52.

Prior to reaching the blade 44, the bottom of each large piece of meat carried by the magazine will have dropped onto the flat upper surface 46 of the cutting table and in its passage around the circular path will have passed over the line of elemental inspection windows of the scanning window shown at 42.

The latter is best understood with reference to FIG. 4s 4*a* and 4*b*. In FIG. 4*a* one of the apertures is denoted by reference numeral 62 and below the aperture are located a transmitting light emitting diode 64 and a semiconductor junction 66 which is sensitive to the incidence of electromagnetic radiation thereon. The light emitting diode has a significant output in the infrared and the detector 66 is likewise selected for its sensitivity to infra-red radiation.

By positioning at least the detector 66 below the solid material surrounding the window, ambient on the detector is largely shielded from ambient radiation incident on the window. In the absence of anything above the window 62, infra-red radiation emitted by the transmitting diode 64 simply passes through the window 62 and in general is not reflected towards the detector 66.

However, if a piece of meat as at 68 is positioned above the window, some of the radiation from the transmitter 64 is reflected towards the detector 66 causing the current through the junction of the detector 66 to change typically increase and register as an output signal.

By arranging similar pairs of transmitter and detector devices below each window along the line of windows 42, the presence or absence of product immediately above each window can be detected by determining the current flowing in the detector junction relating to the window concerned. The larger the piece of meat measured in a radial direction along the length of the line 42, the more of the windows will be covered by the meat and therefore the larger the number of detector devices such as 66 which will record a high output current.

It will be seen that the detector is sensitive to reentrant shapes such as those shown in FIG. 3 at 54 and 56 and will take account of holes in the cross-sectional shape of the product thereby enabling an accurate measure of area to be obtained.

The detector outputs may be summed to produce an output signal whose magnitude will be proportional to the length of the intersection of the linear array with the face of the meat. The detectors in turn starting for example with the radially innermost and moving outwardly and reading each detector in turn at high speed. By sampling the output signal at a high repetition rate, as meat passes over the array so a series of output signals of varying magnitude will be generated which can then be integrated to give an area signal.

If alternatively the detectors are scanned, so that each detector is addressed in turn a discrete separate output pulse can be generated if the output signal from the detector is sufficiently high, and during each scanning of the line of detectors a series of pulses will arise, the number of which will correspond to the length of the array covered by the product. Counting the number of pulses during the passage of the product will give an area value for the product.

In order to take account of the circular movement of the meat over the radially extending line of windows, a correction must be applied to the signals either before or during the integration of the signals arising during the passage of any particular piece of meat over the scanning window so as to compensate for the different path length of the meat product as between the radially inner and outer ends of the line of windows.

FIG. 5 shows the second exit conveyor 70 (previously referred to as conveyor 30) which works in conjunction with the main delivery conveyor 52. Conveyor 70 receives portions of meat or other cut product which are of insufficient thickness to be picked up on the main delivery conveyor 52 and which are carried around by the magazine on a plough-like platform 72 by rotation of the magazine, to be deposited on the exit conveyor 70.

A spoked wheel 74 is provided which can be rotated so as to adjust the tension of the bandsaw. The hub of the wheel 74 extends through a slot 76 in the vertical side wall 78 of the table, the top of which is denoted by reference numeral 46, to enable relative vertical movement between the table and the hub 74 to occur. This is necessary since whilst the bandsaw is to remain stationary (in a vertical sense), the table carrying the conveyors 52 and 70 must be capable of moving relative to the remainder of the machine to adjust the thickness of the meat which is being cut.

One of the uprights of the casing is shown at 80 in FIGS. 5 and 6, and the separate nature of the table relative to the rest of the casing is perhaps best illustrated in FIG. 6 where the exit ends of the conveyors 52 and 70 are seen protruding beyond the upright corner member 80, and the table assembly generally designated 82, is shown having a roller 84 mounted for rotation against one of the vertical surfaces of the corner member 80, to guide the table assembly 82 as it moves in the direction of the arrows 86 and 88 respectively.

Vertical movement of the table assembly 82 is achieved by means of a lead screw to be described in more detail in relation to FIG. 9 and which is housed partially within a casing 90 attached to the underside of the table assembly 82 and partly within a housing 92 which itself is secured to the remainder of the casing 10 and is therefore fixed.

Rotation of the lead screw produces relative movement of the housing 90 and 92, and thereby lifts or lowers the table assembly 82.

Drive to the lead screw is transmitted through a toothed belt 94 from a servo motor and encoder assembly 96 and a safety brake 98 is located at the base of the drive shaft of the lead screw so that the movement of the latter can be arrested in an emergency and at the end of each movement travel.

The lifting mechanism of the lead screw is shown from a different view in FIG. 8 but shows better the alignment of the brake 98 with the lead screw housings 92 and 90 and the position of the servo motor and encoder unit 96.

Within the structure 10 is located an intermediate floor 100 on which two pneumatic jacks 102 and 104 stand. The upper ends of the jacks engage through Nylon (Registered Trade Mark) bushes 106 and 108 with the underside of a main structural member of the table assembly 82 and the two jacks are supplied with air under pressure via high pressure lines 110 and 112. The air pressure to the jacks 102, 104 is arranged at all times during operation to just balance the weight of the table assembly 82 and thereby remove the loading on the screw jack formed by the parts 90, 92 and indirectly on the servo motor 96. This enables the latter to accelerate and decelerate the table assembly 82 at a very high rate without overloading and overheating and enables very rapid changes of table height (and therefore depth of cut) to be achieved, so as to ensure that variation in the area of cross-section of a piece of meat or other product as slices are removed, can be followed by appropriate compensating adjustments in the thickness of the material to be cut, so as to enable substantially constant volume pieces to be delivered to the output conveyor 52.

The jacks 102 and 104 are supplied via a constant pressure device which supplies air to, or bleeds air from the cylinders, as required, so as to follow movement of the table assembly 82, and at the same time maintain the desired weight compensating upward force thereon. By so doing the weight of the table is compensate and this loading which will normally act in a downward direction through the screw jack, is removed.

It is to be understood that the pneumatic jacks are optional and are only required where very high rates of acceleration and deceleration are required of the table assembly 82 so as to rapidly follow changing areas of cross section. If slower response is acceptable or if the machine can be momentarily stopped or slowed down so as to enable the table assembly 82 to be positioned for the correct height of cut, the need for the jacks is reduced.

FIG. 9 shows the upper housing 90 of the screw jack assembly bolted to the underside of the table assembly 82 and the lower housing portion 92 which is bolted to the main structure of the casing 10 (see FIG. 7 at 114 and 116).

Within the lead screw is a drive shaft the lower end of which can be seen at 116 in FIG. 9 and a toothed drive pulley 118 is bushed or otherwise mounted on the shaft 116 to be driven by the toothed belt 94. The belt passes around a drive pulley 120 which is attached to the lower end of the drive shaft of a servo-motor and encoder unit 96. The latter is housed within a casing 122.

Rotation of the shaft 116 produces relative movement of the two housing parts 90 and 92 and thereby controls the height of the table 82 relative to the remainder of the structure of casing 10.

A brake denoted 122, but in essence equivalent to the brake 98 shown in FIGS. 7 and 8, is shown mounted below the lead screw, co-axial with the shaft 116, and when applied, the brake prevents further movement of the lead screw and therefore further separation or drawing together of the two housing parts 90 and 92. The brake can therefore be used as a safety device to prevent the table assembly 82 from being raised too high or moved too low.

I claim:

1. Apparatus for sizing and cutting a product into uniformly sized portions, in which the product to be cut is mounted in a magazine by which it can be rotated around a circular path which intercepts at one point a horizontal section of a bandsaw and at another point the operative field of a sensor disposed in said path from which an electrical signal can be computed which describes the area of the lower end face of the product, wherein said sensor is disposed in a horizontal surface on which the lower end face of the product slides as the product is rotated around the circular path by the magazine, and wherein said horizontal surface on which the lower end face of the product slides is integral with a table assembly which is movable relative to at least the horizontal section of the bandsaw, so as to adjust the depth of the product there below and therefore the thickness of the portion which will be removed by the cutting action of the bandsaw.

2. Apparatus according to claim 1, wherein said sensor comprises a linear array of transmitters and detectors extending radially of said circular path and which may be addressed in sequence and whose outputs may be summed and the resulting analog signal sampled as the product passes over the array, in order to effect a linear scanning of the array, and wherein the presence of product immediately above the array causes transmitted energy to be reflected towards the detectors.

3. Apparatus according to claim 1, wherein the magazine is adapted to carry one or more large pieces of product from which said portions are to be cut, the pieces being circularly arranged around the magazine in use so as to be presented one after another in turn to the bandsaw, the apparatus also including conveyor means for removing cut portions from the path of the magazine to enable them to drop down to present a fresh portion of product for sizing and for cutting by the bandsaw.

4. Apparatus according to claim 1, including drive means for adjusting the height of the table assembly relative to the horizontal section of the bandsaw so as to allow for automatic control of the thickness of the cut portions and feedback means connected to a computer to which area signals are supplied for controlling the depth of cut and therefore the thickness of the portions removed by the bandsaw.

5. Apparatus according to claim 4, wherein the mass of the table assembly is matched by two or more pneumatic jacks acting against the underside of the table assembly and operated from a source of pressurised fluid so as to provide an upward force on the table assembly which is never more than the downward force due to gravity of the table assembly, pressure responsive venting means being provided to enable the jacks to collapse rapidly so as to follow any downward movement of the table without exerting undue upward force on the table during its downward movement.

6. Apparatus according to claim 1, including display means for indicating a computed value for the weight of each cut portion determined by the depth of cut and area of said lower end face.

7. Apparatus according to claim 6, further comprising a check weighing device provided at the outlet of the machine, whereby a signal from the check weighing device is displayed to indicate the actual weight measured.

8. Apparatus according to claim 1, further comprising a drive for the magazine which includes an encoder for circularly defining the position of the magazine relative to the cutting blade and to the sensor for measuring the area.

9. Apparatus according to claim 1, wherein the sensor comprises a radial array of inspection windows positioned approximately 120° in advance of the cutting blade of the horizontal section of the bandsaw, when viewed in the direction of travel around the circular path determined by the rotation of the magazine.

* * * * *